US006334949B1

(12) United States Patent
Bruno et al.

(10) Patent No.: US 6,334,949 B1
(45) Date of Patent: Jan. 1, 2002

(54) PROCESS FOR THE REMOVAL OF CARBONYL SULFIDE FROM LIQUID PETROLEUM GAS

(75) Inventors: Thomas J. Bruno, Broomfield; Anthony F. Lagalante, Boulder, both of CO (US)

(73) Assignee: The United States of America as represented by the Secretary of Commerce, Washington, DC (US)

( * ) Notice: Subject to any disclaimer, the term of this patent is extended or adjusted under 35 U.S.C. 154(b) by 0 days.

(21) Appl. No.: 09/762,132

(22) PCT Filed: Jul. 30, 1999

(86) PCT No.: PCT/US99/16691

§ 371 Date: Jan. 31, 2001

§ 102(e) Date: Jan. 31, 2001

(87) PCT Pub. No.: WO00/08117

PCT Pub. Date: Feb. 17, 2000

Related U.S. Application Data

(60) Provisional application No. 60/095,237, filed on Aug. 4, 1998.

(51) Int. Cl.[7] ..... C10G 29/20

(52) U.S. Cl. ..... 208/238; 208/208 R; 208/240; 208/290; 208/291; 585/820

(58) Field of Search ..... 208/208 R, 238, 208/240, 290, 291; 585/820

(56) References Cited

U.S. PATENT DOCUMENTS

| | | | | |
|---|---|---|---|---|
| 4,208,541 | A | 6/1980 | McClure | 585/860 |
| 4,617,336 | A | 10/1986 | Pastor et al. | 524/291 |
| 4,749,555 | A | 6/1988 | Bush | 423/228 |
| 5,711,927 | A | 1/1998 | Atwood et al. | 423/445 B |

OTHER PUBLICATIONS

Kouichi Miura et al, "Simultaneous Removal of COS and H2S from Coke Oven Gas at Low Temperature by Use of an Iron Oxide," Ind Eng. Chem. Res.. 1992, 31, 415–419. No month.

*Primary Examiner*—Nadine Preisch
(74) *Attorney, Agent, or Firm*—Beverly J Artale

(57) ABSTRACT

A method for the removal of carbonyl sulfide from liquefied petroleum is disclosed. Removal of carbonyl sulfide is accomplished by contacting a liquid petroleum gas stream containing a carbonyl sulfide as an impurity with a calixarene complexing agent as the principal agent for the removal of the carbonyl sulfide.

13 Claims, 4 Drawing Sheets

PROCESS FOR THE REMOVAL OF CARBONYL SULFIDE FROM LIQUID PETROLEUM GAS

This application claims the benefit of U.S. Provisional Application No. 60/095,237, filed Aug. 4, 1998.

FIELD OF THE INVENTION

This invention relates to a method for purifying liquefied petroleum gas. More particularly, this invention relates to a process for the removal of carbonyl sulfide from a liquefied petroleum gas stream utilizing a calixarene as a complexing agent.

BACKGROUND OF THE INVENTION

Liquefied petroleum gas is an important, versatile hydrocarbon fuel and chemical feedstock. It is commercially available as propane or propane-butane mixtures. It also contains ethane, propylene, isobutane, 1-butene, cis- and trans-2-butene, and n-pentane, in minor concentrations.

Liquefied petroleum gas is generally derived from the refining of crude oil, and as a by-product of the production of natural gas. Products derived from these sources, however, are usually contaminated with impurities such as water, carbon dioxide, and organic sulfur compounds. Such undesirable organic sulfur compounds include, for example, hydrogen sulfide, mercaptans, sulfides and carbonyl sulfides.

Carbonyl sulfide was once considered to be a relatively innocuous contaminant, but is now recognized as being problematic for a variety of reasons. In particular, carbonyl sulfide can hydrolyze in the presence of water to form hydrogen sulfide and carbon dioxide. While carbonyl sulfide is not itself corrosive, the hydrolysis product, hydrogen sulfide, is very corrosive, especially in the presence of water. Consequently, the removal of carbonyl sulfide from liquid petroleum products has become increasingly more important to the petroleum fuel processing industry.

Prior processes commonly used in the refinery industry for removal of carbonyl sulfide from hydrocarbons include (1) treating carbonyl sulfide contaminants with gas plant solutions of an amine, e.g. mono ethananol amine (MEA), diethanol amine (DEA) and other similar amines; (2) hydrolysis of carbonyl sulfide to $CO_2$ and $H_2S$ over a catalyst such as activated alumina, platinum sulfide, Co/Mo and other metals; (3) reaction of carbonyl sulfide with a metal oxides such as, for example. ZnO, CuO/ZnO and PbO; (4) adsorption of carbonyl sulfide on a promoted activated alumina or molecular sieves such as 4A, 5A and 13X; and (5) reaction of carbonyl sulfide with potassium hydroxide, sodium hydroxide and/or methanol.

Such processes are, however, disadvantageous for various reasons. For example, carbonyl sulfide reacts rapidly with primary amines such as MEA and DEA to produce salts that can cause equipment fouling. Processes involving hydrolysis of carbonyl sulfide with a catalyst can be complicated and costly since catalyst selection depends on such factors as operating temperature, carbonyl conversion, bed size, estimated life of catalyst, and the like.

Carbonyl sulfide removal with metal oxides is typically not cost effective for most olefin or refinery applications. Metal oxides are sometimes used in the natural gas industry when the concentration of sulfur is very low.

Adsorption processes using molecular sieve products are best for bulk carbonyl sulfide removal at levels of less than 100 ppm where bed outlet levels of 5 ppm are acceptable.

Molecular sieve beds for carbonyl sulfide removal must be very large with short cycles and high regeneration rates. For an olefin unit, E/P feed applications, bed-cycle time and regeneration gas flow requirements are common removal system limits.

Sufnolime™, a solid sodium hydroxide supported on a non-regenerable calcium hydroxide catalyst, has been used in a fixed bed for removal of carbonyl sulfide. Sufnolime™ is microscopic and difficult to remove from the bed. Further, the active catalyst is only 10% to 14% of the catalyst weight; thus, requiring a relatively large bed size.

Potassium hydroxide is more reactive than sodium hydroxide and can remove greater amounts of carbonyl sulfide in liquid/liquid contacting applications. Solid potassium hydroxide beds have also been successful. However, potassium hydroxide can be costly and in some cases, not economically feasible.

Consequently, there exists a need in the petroleum refining industry for simple, economical and efficacious processes for the removal of carbonyl sulfide from hydrocarbons, in particularly, from a liquefied petroleum gas.

Accordingly, it is an advantage of the present invention to provide a process for the removal of carbonyl sulfide from a liquid petroleum gas using a solid complexing agent.

It is also an advantage of the present invention to provide a process for the removal of carbonyl sulfide from a liquid petroleum gas utilizing a calixarene complexing agent.

It is a further advantage of the present invention to provide a process for the selective removal of carbonyl sulfide from liquid petroleum gas stream utilizing a solid calixarene complexing agent.

Additional advantages and objects of the invention will be set forth in part in the description, and in part will be obvious from the description, or may be learned by practice of the invention. Other advantages and objects of this invention may be realized and obtained by means of the process particularly pointed out in the appended claims.

SUMMARY OF THE INVENTION

We have now discovered that a calixarene selectively reacts with carbonyl sulfide contained in a liquid petroleum gas stream to form a stable complex which can be isolated and removed from the gas stream. The formation of this complex provides the basis for a simple and economical process for the removal of carbonyl sulfide from liquefied petroleum gas.

Accordingly, the method of the present invention comprises contacting a liquefied petroleum gas stream containing carbonyl sulfide as an impurity with a calixarene complexing agent. The liquefied petroleum stream is contacted with the desired calixarene in an amount sufficient to remove all or substantially all of the carbonyl sulfide contained in the petroleum stream.

DETAILED DESCRIPTION OF THE INVENTION

The present invention embodies a process wherein carbonyl sulfide is removed from a liquefied petroleum gas stream by utilizing a solid calixarene as a complexing agent. In accordance with the process of the invention, carbonyl sulfide contaminated liquefied petroleum gas is flowed into intimate contact with the calixarene complexing agent. The complexing agent acts to selectively complex carbonyl sulfide and form a stable calixarene/carbonyl sulfide complex.

The treated petroleum gas is thereafter removed from the contactor to isolate the gas from the calixarene/carbonyl complex. Once isolated, the complex maybe gently heated to release carbonyl sulfide and regenerate the calixarene for reuse.

As used herein, the expression "liquefied or liquid petroleum gas" refers to a liquid hydrocarbon composition consisting mainly of propane and/or propane-butane mixtures. The liquid hydrocarbon may also contain ethane, propylene, isobutane, 1-butene, cis- and trans-2-butane, and n-pentane in minor concentrations.

Suitable calixarene complexing agents useful for practicing the present invention include those of formula I:

I

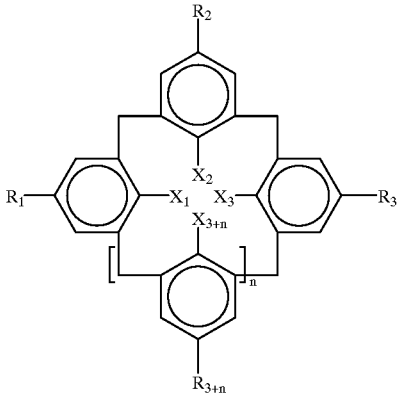

wherein $R_1$,–$R_{3+n}$ are each independently H, primary $C_{1-20}$ alkyl, secondary $C_{3-20}$ alkyl, tertiary $C_{4-20}$ alkyl, $C_{1-20}$ alkoxy, $C_{1-20}$ thioalkyl, $C_{6-20}$ aryl, $C_{6-20}$ aryloxy, $C_{6-20}$ aryl, nitro, halogen and $CH_2NR_2{}^1$ where $R^1$ is a $C_{1-20}$ alkyl;

$X_1$–$X_{3+n}$ are each independently H, OH, SH, $C_{1-20}$ alkoxy, $C_{1-20}$ thioalkyl, $C_{6-20}$ aryloxy, $OC(O)C_{1-20}$ alkyl and $C_{2-20}$ alkenyloxy; and n is an integer of 1 to 5, preferably n is 4.

Preferably, $R_1$–$R_{3+n}$ may be hydrogen, methyl, ethyl, propyl, isopropyl, butyl, iso-butyl, sec-butyl, tert-butyl, phenyl, xylyl, phenyoxy, naphthyl, benzyl, fluorine, chlorine, bromine and iodine, methoxy, ethoxy, propoxy butoxy, N,N-dimethyl methyleneamine, N-N-diethyl methyleneamine, N,N-dipropyl methyleneamine, N,N-diphenyl methyleneamine, $C_{6-20}$ aryl, $NO_2$ or $CH_2NR^1{}_2$ where $R^1$ is a $C_{1-20}$ alkyl.

Preferably $X_1$–$X_{3+n}$ may be H, OH, methoxy, ethoxy and propoxy.

More specifically, suitable calixarenes are calix[4]arene and substituted derivatives thereof. In a preferred embodiment of the invention, the calixarene is a para substituted derivative of calix[4]arene. Most preferably, the calixarene is para-t-butyl calix[4]arene.

The synthesis of calixarenes and substituted calixarenes is well known to those of ordinary skill in the art and can be prepared by conventional methods. For example the synthesis of p-phenylcalix[4]arene is described in Juneja et al (*J. Am. Chem. Soc.* 1993 115:3813–3819). The synthesis of p[4-(2-hydroxyethyl) piperazinomethyl]calix[4]arene is described by Atwood et al (*Angew. Chem. Int. Ed. Engl.* 1993 32:1093–94).

Figure 1:
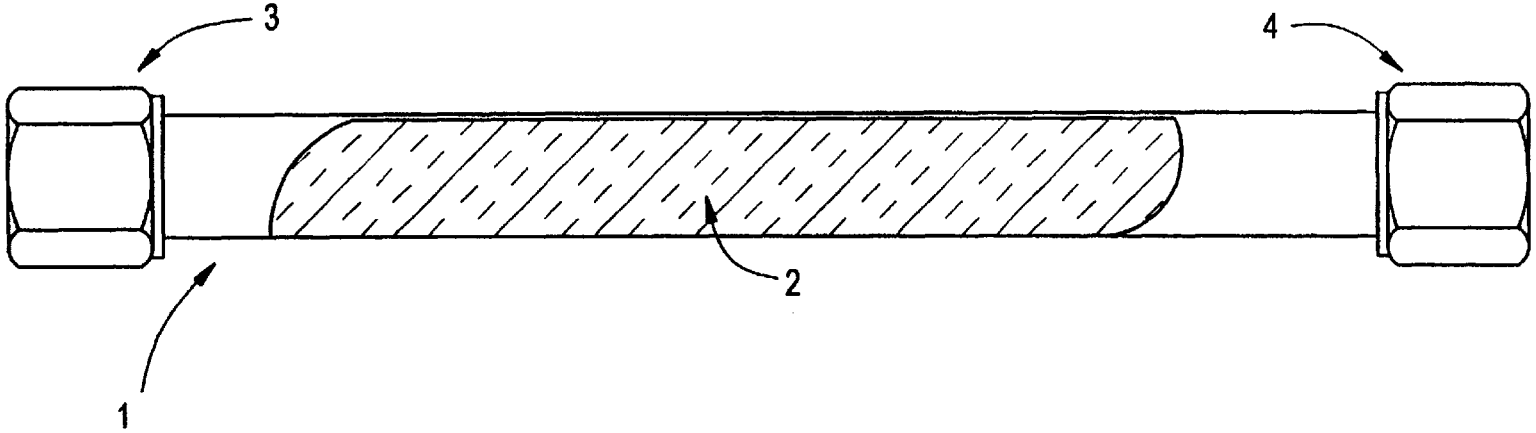
FIG. 1 illustrates a solid-liquid contactor system useful to perform the process of the present invention.

Contact between the liquefied petroleum gas and the complexing agent may be accomplished using any conventional contactor system which allows one to intimately mix solid and liquid components. In one embodiment of the invention, a stream of liquefied petroleum containing carbonyl sulfide as an impurity is flowed into a solid-liquid contactor containing a solid calixarene complexing agent. Suitable solid-liquid contactor systems include, but are not limited to, packed columns, coated cakes, structured tubes, supports, saddles and the like. Typically, as shown in FIG. 1, the solid-liquid contactor comprises a column (1) having an inlet end (3) and an outlet end (4) for passage of the liquid gas stream, packed with a solid calixarene complexing agent (2).

The flow rate of the liquefied petroleum stream is such to provide effective contact between the complexing agent and the liquid petroleum gas to remove all or substantially all of the carbonyl sulfide contained in the petroleum gas stream. The selection of the flow rate can easily be determined by one skilled in the art based on such factors as the nature of the solid-liquid contactor, the concentration of complexing agent present in the contactor, the amount of carbonyl sulfide impurity in the petroleum stream, and the like.

In another embodiment of the present invention, a carbonyl sulfide contaminated stream of liquefied petroleum gas is flowed into intimate contact with a calixarene complexing agent, wherein the complexing agent is immobilized on an inert support.

Immobilization of the complexing agent may be accomplished by any means wherein immobilization does not prevent the calixarene from forming a stable complex with carbonyl sulfide. For example, in the case of the calix[4] arene and derivatives thereof, immobilization may be by coupling through the R group, to the immobilized support. The R group may be bonded directly to the immobilized support. Alternatively, binding of the calix[4]arene to the immobilized support may be through one of the —OH groups at the para position to the R group.

Suitable inert supports include for example polystrene, polyester, polyamide, poly(meth) acrylate, polyurethane and polyvinyl chloride. The inert support must be a material such that when the complexing agent is bound to the support, the material does not interfere the complexation reaction of the complexing agent with carbonyl sulfide.

Purification using the immobilized calixarene may be performed using the immobilized agent as a chromatographic support. The column of the immobilized complexing agent is contacted with a crude liquefied petroleum gas stream under conditions sufficient to form a complex of the carbonyl sulfide with the immobilized calixarene complexing agent.

Throughout the process of the invention, the temperature of the contactor system must be compatible to maintain the liquid petroleum gas in a liquid state. The temperature will vary depending on the composition of the petroleum gas. In general, however, the temperature is maintained at a range of about 40° C. to about 200° C., preferably about 80° C. to about 150° C.

The pressure of the system is correlated with the temperature range to assure that the petroleum gas is maintained in the liquid state throughout the process. Preferably, the pressure is about 50 to about 500 psig, most preferably about 100 to about 400 psig.

The amount of calixarene complexing agent to be used in the present invention will vary depending on such factors as, for example, the concentration of carbonyl sulfide existing in the liquefied gas stream, the hydrocarbon composition of the gas stream, the particular calixarene complexing agent used, the nature of the contactor system and the contact time, temperature and pressure.

Generally, the amount of calixarene is that amount effective to remove and achieve the desired level of carbonyl sulfide removal. Such amount is easily determined by one skilled in the art through routine experimentation. For example, p-t-butylcalix[4]arene has a carbonyl sulfide uptake factor of 0.41. This means that for every gram of p-t-butylcalix[4]arene that is contacted with carbonyl sulfide contained in a petroleum gas stream, 0.41 grams of carbonyl sulfide will be complexed. In terms of moles, the ratio of carbonyl sulfide to p-t-butylcalix[4]arene is 4.42. Consequently, each p-t-butylcalix[4]arene molecule is capable of complexing 4.4 carbonyl sulfide molecules.

As will be obvious to one skilled in the art, the period of time for intimately contacting the calixarene complexing agent with the crude petroleum gas stream will vary depending upon the amount of carbonyl sulfide desired to be removed. In general, the petroleum stream is contacted with complexing agents from about 0.3 to about 1 minute.

Once the carbonyl sulfide is complexed on the calixarene complexing agent the complex may be isolated from the purified gas stream using conventional separation techniques, such as filtration, decanting, centrifugation and the like. Following isolation, the complex may be gently heated to release carbonyl sulfide and regenerate the complexing agent. In general, the complex is heated at a temperature of about 85° C. to about 150° C. for about 20 minutes to about 2 hours to retrieve the calixarene complexing agent. The retrieved complexing agent may be reused in subsequent carbonyl sulfide removal treatments.

It should be understood that the process of the present invention is not to be limited to the use of the invention as described above, and modifications within the foregoing description can be made while still falling within the spirit of the present invention. For example, it is possible to perform the present invention by simply mixing the calixarene complexing agent with a liquefied petroleum gas containing carbonyl sulfide as an impurity in any suitable mixing tank under conditions sufficient for formation of the carbonyl sulfide/calixarene complex, and thereafter separating the carbonyl sulfide-free gas from the complex.

Other features of the invention will become apparent in view of the following Examples which are given for illustration of the invention and are not intended to be limiting thereof.

EXAMPLE 1

A simple manifold was constructed to allow controlled contact between carbonyl sulfide and p-t-butylcalix[4]arene. Approximately 0.01 grams of p-t-butylcalix[4]arene was placed in a stainless steel fitting in the manifold. The manifold was pressurized with carbonyl sulfide at 165 psi and allowed to equilibrate for 1 hour. At the end of the hour the manifold was depressurized and the carbonyl sulfide vented.

Subsequent analysis with Fourier transform infrared spectrometry (FTIR), using a potassium bromide pellet formed form the carbonyl sulfide exposed p-t-butylcalix[4]arene revealed that, in fact, a stable complex was formed. Results are recorded in FIG. 2.

Figure 2A:
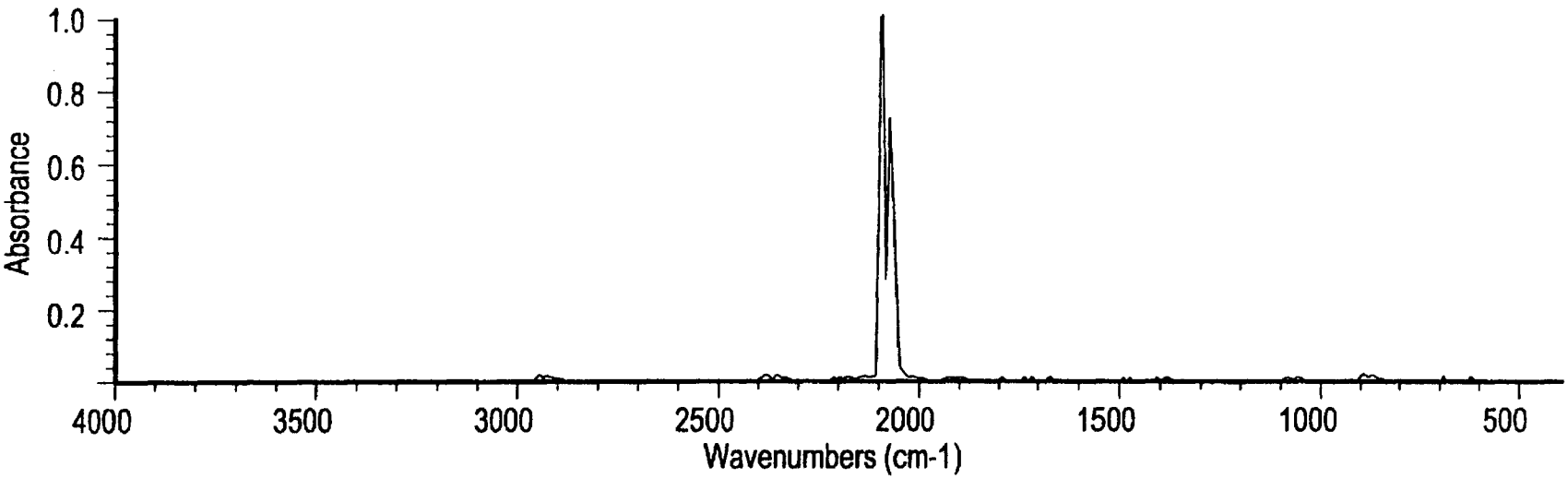
FIG. 2A illustrates a Fourier transform infrared septrum of carbonyl sulfide.
Figure 2B:
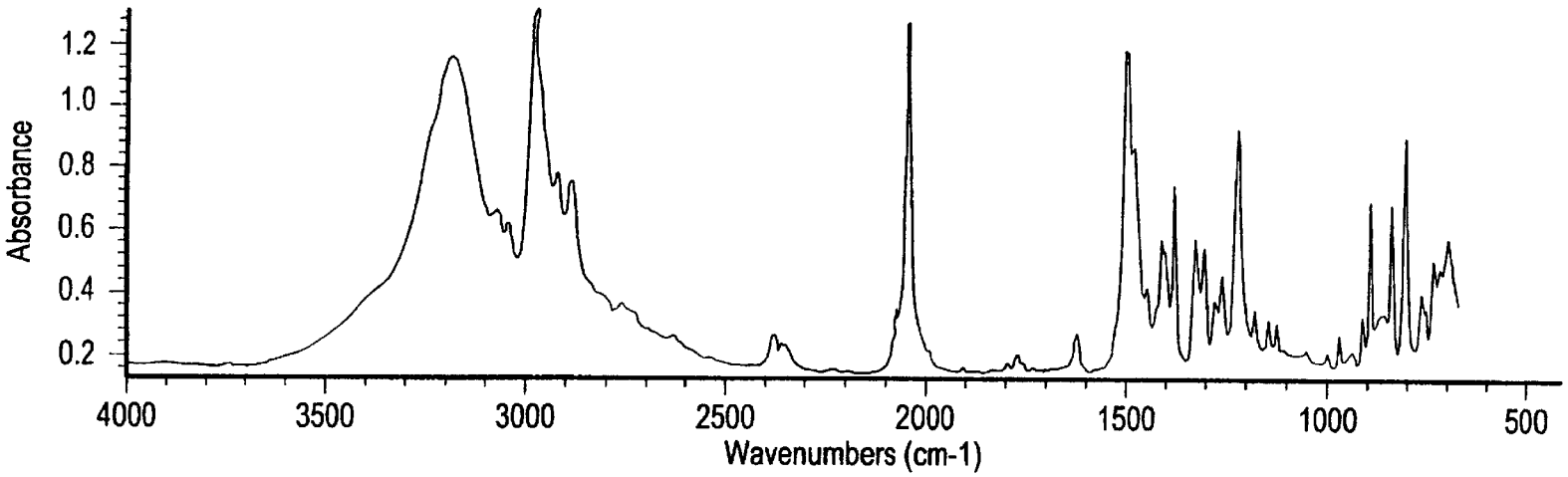
FIG. 2B illustrates a Fourier transform infrared septrum of p-t-butylcalix[4]arene complexed with carbonyl sulfide.
Figure 2C:
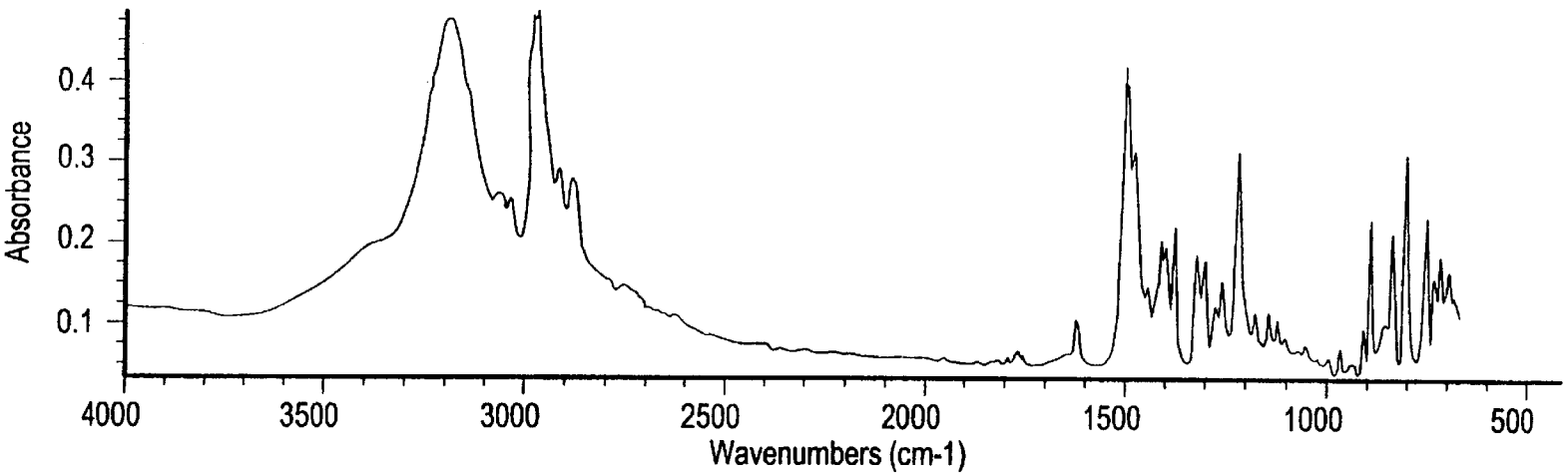
FIG. 2C illustrates a Fourier transform infrared septrum of p-t-butylcalix[4]arene.

As shown in FIG. 2, the major carbonyl sulfide absorption was a packet centered at 2061 $cm^{-1}$. In the spectrum of the exposed p-t-butylcalix[4]arene, this packet was shifted to 2022 $cm^{-1}$. This shift in an inclusion complex was not unusual. This carbonyl sulfide/p-t-butylcalix[4]arene peak (at 2022 $cm^{-1}$) persisted after the pellet was allowed to stand in ambient air overnight, and after the pellet had been reground. This indicated that the complex was very stable.

Figure 3:
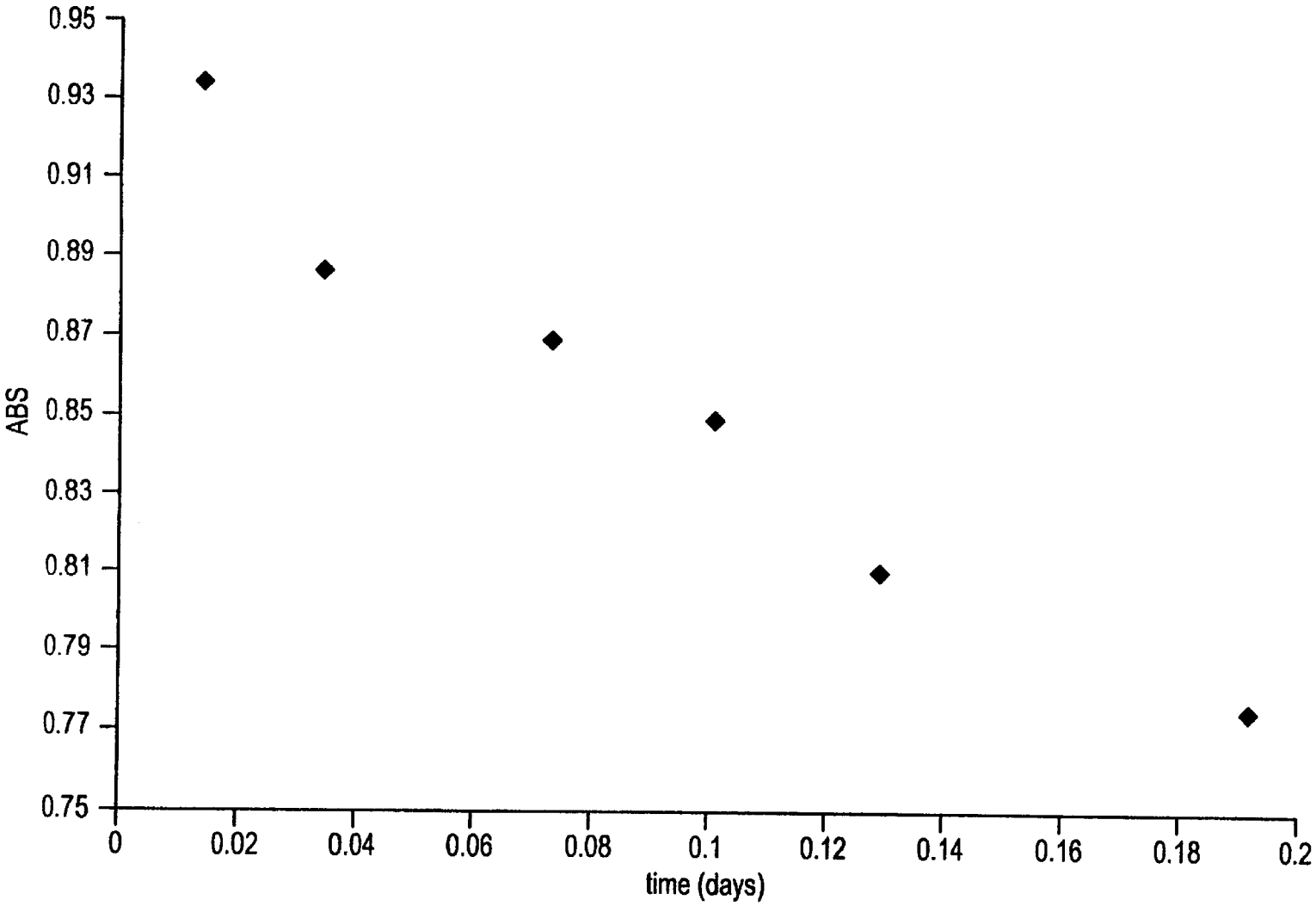
FIG. 3 illustrates a plot detailing the absorbance of carbonyl sulfide by p-t-butylcalix[4]arene as a function of time.

Temperature dependent measurements indicated that the complex could be disrupted by gentle heating to 85° C. FTIR peak absorbance was monitored as a function of time. Results were recorded in FIG. 3. The decrease in FTIR peak absorbance in FIG. 3 indicated the gradual release of carbonyl sulfide from the complex.

EXAMPLE 2

The procedure of Example 1 was repeated but instead of mixing the exposed p-t-butylcalix[4]arene with potassium bromide for analysis by FTIR, the p-t-butylcalix[4]arene exposed to carbonyl sulfide was placed in a stream of humidified nitrogen. 100% relative humidity nitrogen was passed over the exposed p-t-butylcalix[4]arene at a rate of 1.0 liter per minute for 30 minutes. After exposure to humidified nitrogen, FTIR analysis using a potassium bromide pellet formed from the carbonyl sulfide exposed p-t-butylcalix[4]arene revealed that the carbonyl sulfide was still present in the complex and had not reacted with the water vapor.

EXAMPLE 3

The uptake level of carbonyl sulfide by p-t-butylcalix[4] arene was determined.

Figure 4:
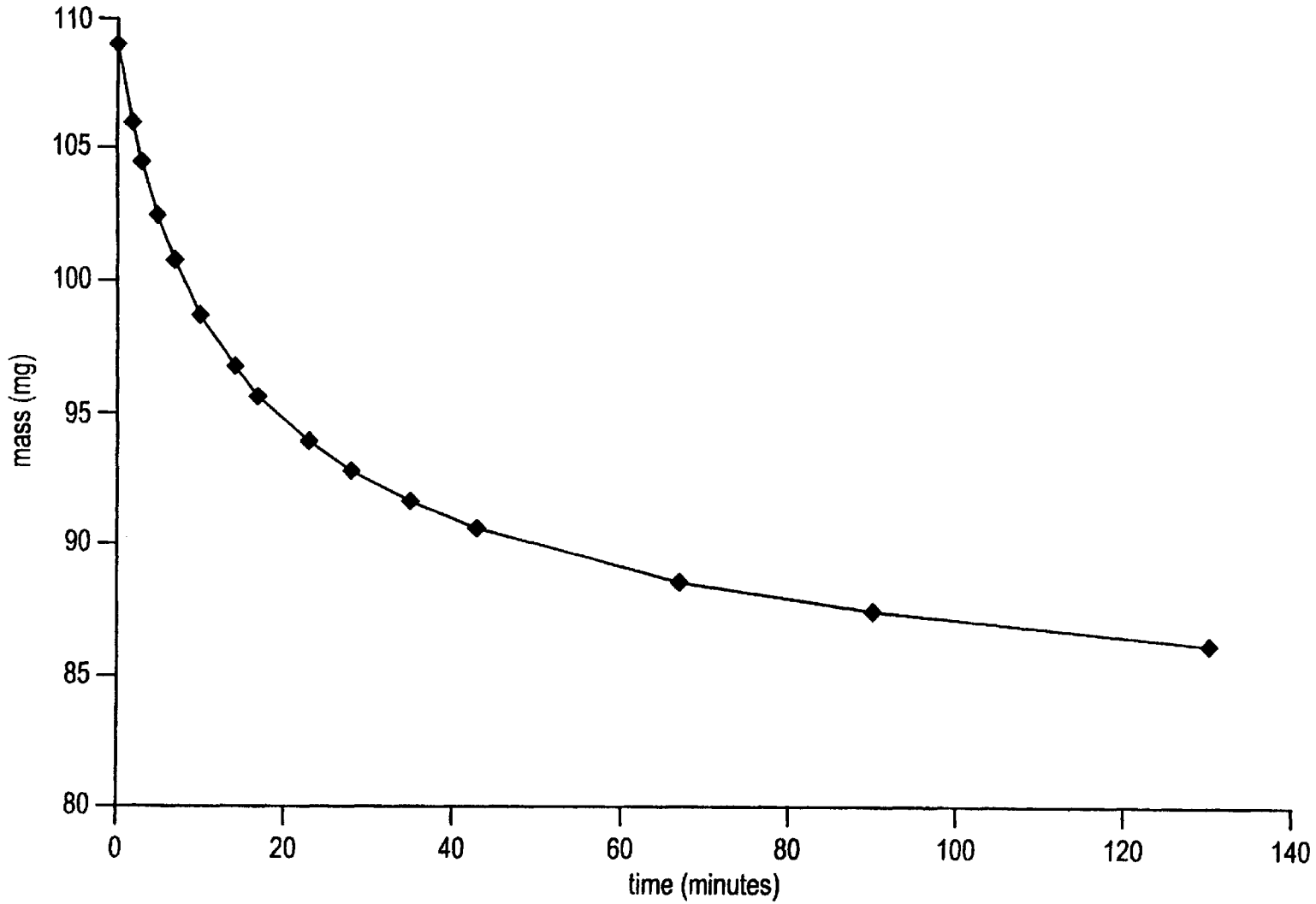
FIG. 4 illustrates a plot detailing the gravimetric decay of carbonyl sulfide by p-t-butylcalix[4]arene.

76.914 mg of p-t-butylcalix[4]arene was weighed into a boat in a manifold. The boat was exposed to carbonyl sulfide at 165 psi for 1 hour. The boat was removed and placed on an analytical balance to measure the weight loss as a function of time. Results are shown in FIG. 4.

Initially, the mass of the exposed p-t-butylcalix[4]arene was 109 mg which indicates that the capacity for carbonyl sulfide uptake by p-t-butylcalix[4]arene is significant. The uptake factor was determined to be 0.41. This means that for every gram of p-t-butylcalix[4]arene that is exposed, 0.41 grams of carbonyl sulfide is complexed. This is a far higher uptake that would be expected from a simple adsorbent. Over 130 minutes, the uptake factor fell to 0.12 which corresponds to the formation of a 1:1 complex of carbonyl sulfide/p-t-butylcalix[4]arene.

Obviously, numerous modifications and variations of the present invention are possible in light of the above teaching. It is therefore to be understood that within the scope of the appended claims, the invention may be practiced otherwise than as specifically described herein.

We claim:

1. A process for the removal of carbonyl sulfide from liquefied petroleum gas stream, which method comprises contacting (a) a liquefied petroleum gas containing carbonyl sulfide as an impurity; and (b) a calixarene complexing agent in an amount sufficient to remove said carbonyl sulfide from the petroleum gas stream; and recovering the carbonyl sulfide-free liquid petroleum gas stream.

2. The process of claim 1 wherein the liquefied petroleum gas and the calixarene complexing agent is contacted at a temperature and pressure effective to retain said petroleum gas stream in the liquid state.

3. The process of claim 2 wherein the contact is carried out at a temperature of about 40° C. to about 200° C.

4. The process of claim 1 wherein the calixarene complexing agent is of the formula I

I

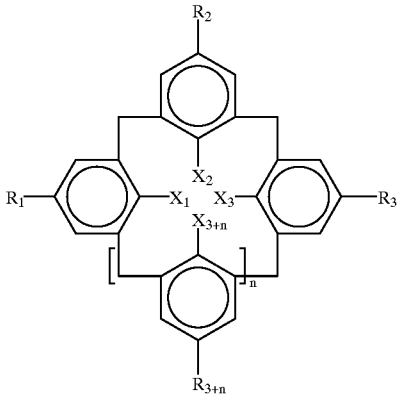

wherein $R_1$–$R_{3+n}$ are each independently H, primary $C_{1-20}$ alkyl, secondary $C_{3-20}$ alkyl, tertiary $C_{4-2\ 20}$ alkyl, $C_{1-20}$ alkoxy, $C_{1-20}$ thioalkyl, $C_{6-20}$ aryl, $C_{6-20}$ aryloxy, $C_{6-20}$ aryl, nitro, halogen and $CH_2NR_2^1$ where $R^1$ is a $C_{1-20}$ alkyl;

$X_1$–$X_{3+n}$ are each independently H, OH, SH, $C_{1-20}$ alkoxy, $C_{1-20}$ thioalkyl, $C_{6-20}$ aryloxy, $OC(O)C_{1-20}$ alkyl and $C_{2-20}$ alkenyloxy; and n is an integer of 1 to 5.

5. The process of claim 4 wherein n is 4.

6. The process of claim 5 wherein the calixarene complexing agent is a para-substituted calix[4]arene.

7. The process of claim 6 wherein the calixarene complexing agent is p-t-butyl-calix[4]arene.

8. The process of claim 1 wherein the calixarene complexing agent is a solid.

9. The process of claim 1 wherein the calixarene complexing agent is immobilized on an inert support.

10. The process of claim 1 wherein the calixarene complexing agent is used in an amount sufficient to remove substantially all of the carbonyl sulfide from the liquefied petroleum gas.

11. The process of claim 1 wherein the liquefied petroleum gas comprises a liquid hydrocarbon selected from the group consisting of propane, butane and mixtures thereof.

12. The process of claim 11 wherein the liquid hydrocarbon further comprises hydrocarbons selected from the group consisting of ethane, propylene, isobutane, butene, pentane and mixtures thereof.

13. A process for the removal of carbonyl sulfide from a liquid hydrocarbon, which method comprises contacting (a) a liquid hydrocarbon containing carbonyl sulfide as an impurity; and (b) a calixarene complexing agent in an amount sufficient to remove said carbonyl sulfide from the liquid hydrocarbon; and recovering the carbonyl sulfide-free liquid hydrocarbon.

* * * * *